US008166776B2

(12) United States Patent
Kopko et al.

(10) Patent No.: US 8,166,776 B2
(45) Date of Patent: May 1, 2012

(54) MULTICHANNEL HEAT EXCHANGER

(75) Inventors: William L. Kopko, Jacobus, PA (US); Jose Ruel Yalung De la Cruz, Dover, PA (US); Glenn Eugene Nickey, New Oxford, PA (US); Mustafa Kemal Yanik, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 865 days.

(21) Appl. No.: 12/180,017

(22) Filed: Jul. 25, 2008

(65) Prior Publication Data

US 2009/0025409 A1 Jan. 29, 2009

Related U.S. Application Data

(63) Continuation-in-part of application No. 11/965,314, filed on Dec. 27, 2007.

(60) Provisional application No. 60/952,280, filed on Jul. 27, 2007.

(51) Int. Cl.
*F25B 41/00* (2006.01)

(52) U.S. Cl. ..... 62/513; 62/186; 62/507

(58) Field of Classification Search ..... 62/507, 62/79, 186, 513, 228.1
See application file for complete search history.

(56) References Cited

U.S. PATENT DOCUMENTS

| | | | |
|---|---|---|---|
| 3,074,479 | A | 1/1963 | Giauque |
| 3,229,722 | A | 1/1966 | Kritzer |
| 3,737,978 | A | 6/1973 | Rathbun |
| 4,645,000 | A | 2/1987 | Scarselletta |
| 4,958,681 | A | 9/1990 | Kadle |
| 4,971,145 | A | 11/1990 | Lyon |
| 5,014,771 | A | 5/1991 | Lederer et al. |
| 5,022,814 | A | 6/1991 | Breda et al. |
| 5,062,476 | A | 11/1991 | Ryan et al. |
| 5,120,189 | A | 6/1992 | Breda et al. |
| 5,127,154 | A | 7/1992 | Johnson et al. |
| 5,130,173 | A | 7/1992 | Barten et al. |
| 5,147,083 | A | 9/1992 | Halstead et al. |
| 5,150,596 | A | 9/1992 | Hunt et al. |
| 5,168,925 | A | 12/1992 | Suzumura |
| 5,172,847 | A | 12/1992 | Barten et al. |
| 5,172,848 | A | 12/1992 | Barten et al. |
| 5,172,849 | A | 12/1992 | Barten et al. |
| 5,176,205 | A | 1/1993 | Anthony |

(Continued)

FOREIGN PATENT DOCUMENTS

| | | |
|---|---|---|
| DE | 387330 | 12/1923 |

(Continued)

*Primary Examiner* — Melvin Jones
(74) *Attorney, Agent, or Firm* — McNees Wallace & Nurick LLC

(57) ABSTRACT

A heating, ventilation, air conditioning and refrigeration (HVAC&R) system having a compressor, a heat exchanger, an expansion valve, and a multichannel heat exchanger connected in a closed refrigerant loop. The multichannel heat exchanger has at least two fluid flow paths cooled by a flow of air from an air-moving device through the multichannel heat exchanger. Each of the at least two fluid flow paths have an inlet and an outlet in communication there between. The multichannel heat exchanger also has at least one flow regulator disposed in at least one outlet to regulate through at least one fluid flow path in response to the air flow through the heat exchanger to achieve a substantially equal temperature of a fluid flowing in the at least two flow paths.

27 Claims, 11 Drawing Sheets

U.S. PATENT DOCUMENTS 5,186,248 A 2/1993 Halstead
5,186,249 A 2/1993 Bhatti et al.
5,195,673 A 3/1993 Irish et al.
5,201,117 A 4/1993 Wright
5,206,990 A 5/1993 Wright
5,234,302 A 8/1993 Gawve et al.
5,246,066 A 9/1993 Morgan et al.
5,327,959 A 7/1994 Saperstein
5,341,978 A 8/1994 Halstead et al.
5,366,004 A 11/1994 Garner et al.
5,372,188 A 12/1994 Dudley
5,377,901 A 1/1995 Rungta et al.
5,460,895 A 10/1995 Rungta et al.
5,479,784 A 1/1996 Dobmeier
5,582,244 A 12/1996 Helms et al.
5,586,598 A 12/1996 Tanaka et al.
5,607,012 A 3/1997 Buchanan et al.
5,706,695 A 1/1998 Helms et al.
5,730,214 A 3/1998 Beamer et al.
5,765,393 A 6/1998 Shlak et al.
5,826,646 A 10/1998 Bae
5,829,133 A 11/1998 Joshi et al.
5,836,382 A 11/1998 Dingle
5,898,996 A 5/1999 Buchanan et al.
5,901,782 A 5/1999 Voss
5,904,206 A 5/1999 Kroetsch
5,910,167 A 6/1999 Reinke
5,934,367 A 8/1999 Shimmura
5,941,303 A 8/1999 Gowan et al.
6,036,083 A 3/2000 Luo et al.
6,115,918 A 9/2000 Kent
6,116,335 A 9/2000 Beamer et al.
6,148,635 A 11/2000 Beebe
6,155,075 A 12/2000 Hanson
6,199,401 B1 3/2001 Haussmann
6,237,677 B1 5/2001 Kent et al.
6,276,443 B1 8/2001 Martin, Sr.
6,446,857 B1 9/2002 Kent et al.
6,449,979 B1 9/2002 Nagasawa
6,467,535 B1 10/2002 Shembekar et al.
6,502,413 B2 1/2003 Repice
6,513,582 B2 2/2003 Krupa et al.
6,615,488 B2 9/2003 Anders et al.
6,619,380 B1 9/2003 Hartman et al.
6,662,615 B2 12/2003 Hunt
6,688,137 B1 2/2004 Gupte
6,694,762 B1 2/2004 Osborne
6,749,901 B1 6/2004 Ghosh et al.
6,755,339 B2 6/2004 Lamothe et al.
6,799,631 B2 10/2004 Acre
6,814,136 B2 11/2004 Yi
6,827,128 B2 12/2004 Philpott
6,868,696 B2 3/2005 Ikuta
6,886,349 B1 5/2005 Curicuta
6,892,802 B2 5/2005 Kelly
6,904,770 B2 6/2005 Telesz
6,904,966 B2 6/2005 Philpott
6,912,864 B2 7/2005 Roche
6,932,153 B2 8/2005 Ko
6,949,300 B2 9/2005 Gillispie et al.
6,957,762 B2 10/2005 Kroetsch et al.
6,964,296 B2 11/2005 Memory
6,988,538 B2 1/2006 Merkys
7,000,415 B2 2/2006 Daddis
7,003,971 B2 2/2006 Kester
7,007,743 B2 3/2006 Calhoun et al.
7,021,370 B2 4/2006 Papapanu
7,024,884 B2 4/2006 Kent et al.
7,028,483 B2 4/2006 Mansour
7,044,200 B2 5/2006 Gupte
7,059,050 B2 6/2006 Calhoun et al.
7,066,243 B2 6/2006 Horiuchi
7,080,526 B2 7/2006 Papapanu
7,080,683 B2 7/2006 Bhatti et al.
7,107,787 B2 9/2006 Inaba
7,143,512 B2 12/2006 Kroetsch et al.
7,143,605 B2 12/2006 Rohrer
7,152,669 B2 12/2006 Kroetsch et al.
7,163,052 B2 1/2007 Taras
7,201,015 B2 4/2007 Feldman
7,207,378 B2 4/2007 Kroetsch et al.
7,213,640 B2 5/2007 Fuller
7,213,737 B2 5/2007 Brittin et al.
7,219,511 B2 5/2007 Inaba
7,222,501 B2 5/2007 Cho
7,253,372 B2 8/2007 Ananthanarayanan et al.
7,320,360 B2 1/2008 Leitch et al.
7,331,382 B2 2/2008 Misiak et al.
7,337,832 B2 3/2008 Hu
7,942,020 B2 * 5/2011 Knight et al. ..... 62/519
7,980,094 B2 * 7/2011 Yanik et al. ..... 62/506
2004/0021983 A1 2/2004 Kanaguchi et al.
2004/0118150 A1 6/2004 Yamada et al.
2005/0076506 A1 4/2005 Kanada
2005/0241816 A1 11/2005 Shabtay et al.
2005/0269069 A1 12/2005 Hancock
2006/0101849 A1 5/2006 Taras et al.
2006/0130517 A1 6/2006 Merkys
2007/0017664 A1 1/2007 Beamer et al.
2007/0039724 A1 2/2007 Trumbower
2007/0131784 A1 6/2007 Garozzo et al.
2007/0204977 A1 9/2007 Beamer et al.
2007/0204978 A1 9/2007 Beamer
2007/0227695 A1 10/2007 Beamer et al.
2007/0246206 A1 10/2007 Gong et al.
2007/0271936 A1 11/2007 Wakamoto et al.
2008/0023182 A1 1/2008 Beamer et al.
2008/0023183 A1 1/2008 Beamer et al.
2008/0023184 A1 1/2008 Beamer et al.
2008/0023185 A1 1/2008 Beamer et al.
2008/0023186 A1 1/2008 Beamer et al.
2008/0060199 A1 3/2008 Fuller et al.
2008/0078541 A1 4/2008 Beamer et al.
2008/0092568 A1 4/2008 Ookoshi et al.
2008/0092573 A1 4/2008 Vaisman et al.
2008/0092576 A1 4/2008 Hoffman et al.
2008/0092586 A1 4/2008 Kitaichi et al.
2008/0092587 A1 4/2008 Gorbounov et al.
2008/0093062 A1 4/2008 Gorbounov et al.
2008/0095653 A1 4/2008 Shoulders
2008/0099191 A1 5/2008 Taras et al.
2008/0104975 A1 5/2008 Gorbounov et al.
2008/0105420 A1 5/2008 Taras et al.

FOREIGN PATENT DOCUMENTS

DE 19740114 3/1999
DE 10350192 A1 5/2004
EP 0219974 9/1986
EP 0583851 9/1986
EP 1086341 11/1999
EP 1016557 7/2000
EP 1016557 A 7/2000
EP 1379817 10/2002
EP 1391664 2/2004
EP 1426714 6/2004
EP 1426714 A 6/2004
EP 1491608 12/2004
EP 1939573 7/2008
FR 2807149 3/2000
FR 2807149 A 10/2001
GB 2027533 5/1979
JP 4177069 A 6/1992
JP 04186070 7/1992
JP 10062092 3/1998
TW 487797 5/2002
TW 200303409 9/2003
WO 02103263 12/2002
WO 2002103270 12/2002
WO 2006083426 8/2006
WO 2006083435 8/2006
WO 2006083441 8/2006
WO 2006083442 8/2006
WO 2006083443 8/2006
WO 2006083445 8/2006
WO 2006083446 8/2006
WO 2006083447 8/2006
WO 2006083448 8/2006

| | | |
|---|---|---|
| WO | 2006083449 | 8/2006 |
| WO | 2006083450 | 8/2006 |
| WO | 2006083451 | 8/2006 |
| WO | 2006083484 | 8/2006 |
| WO | 2007129851 | 11/2007 |
| WO | 2008038948 | 4/2008 |
| WO | 2008045039 | 4/2008 |
| WO | 2008045040 | 4/2008 |
| WO | 2008045084 | 4/2008 |
| WO | 2008045086 | 4/2008 |
| WO | 2008045111 | 4/2008 |
| WO | 2008045113 | 4/2008 |
| WO | 2008048252 | 4/2008 |
| WO | 2008048264 | 4/2008 |
| WO | 2008060270 | 5/2008 |
| WO | 2008061297 | 5/2008 |
| WO | 2008061960 | 5/2008 |
| WO | 2008063256 | 5/2008 |
| WO | 2008064199 | 5/2008 |
| WO | 2008064219 | 5/2008 |
| WO | 2008064228 | 5/2008 |
| WO | 2008064238 | 5/2008 |
| WO | 2008064243 | 5/2008 |
| WO | 2008064247 | 5/2008 |
| WO | 2008064251 | 5/2008 |
| WO | 2008064263 | 5/2008 |
| WO | 2008105760 | 9/2008 |
| WO | 2008105763 | 9/2008 |

* cited by examiner

MULTICHANNEL HEAT EXCHANGER

CROSS REFERENCE TO RELATED PATENT APPLICATIONS

This application is a continuation in part of application Ser. No. 11/965,314 filed Dec. 27, 2007, entitled "CONDENSER REFRIGERANT DISTRIBUTION" for which priority is claimed and whose disclosure is incorporated by reference in its entirety, and which claims the benefit of PCT Patent Application No. US2007/088946, filed on Dec. 27, 2007, entitled "CONDENSER REFRIGERANT DISTRIBUTION", and U.S. Provisional Patent Application No. 60/952,280, filed on Jul. 27, 2007, entitled "SINGLE PASS MICROCHANNEL CONDENSER COIL DESIGN IMPROVEMENT", which relate to multichannel technology and are hereby incorporated by reference in their entirety into this application.

BACKGROUND

This application relates to multichannel heat exchanger applications. This application relates more specifically to multichannel heat exchanger applications in HVAC&R systems.

In a multichannel heat exchanger or multichannel heat exchanger coil, a series of tube sections are physically and thermally connected by fins. The fins are configured to permit airflow through the multichannel heat exchanger and promote heat transfer to a circulating fluid, such as water or refrigerant, that is being circulated through the multichannel heat exchanger. The tube sections of the multichannel heat exchanger extend either horizontally or vertically within the multichannel heat exchanger. Each tube section has several tubes or channels that circulate the fluid. The outside of each tube section may be a continuous surface with a generally oval or generally rectangular shape.

Multichannel heat exchangers may be used in residential, industrial or commercial HVAC&R environments or other suitable vapor compression systems. A HVAC&R system may include a compressor, a condenser, an expansion valve, and an evaporator to facilitate heat transfer in a cooling mode or heating mode. In HVAC&R systems involving heat transfer, the condenser may operate as a heat exchanger.

Multichannel heat exchangers may incur a pressure drop and uneven air distribution across the heat exchanger coils, resulting in inefficient operation of the heat exchanger.

SUMMARY

One embodiment is directed to a heating, ventilation, air conditioning and refrigeration (HVAC&R) system having a compressor, a heat exchanger, an expansion valve, and a multichannel heat exchanger connected in a closed refrigerant loop. The multichannel heat exchanger has at least two fluid flow paths cooled by a flow of air from an air-moving device through the multichannel heat exchanger. Each of the at least two fluid flow paths having an inlet and an outlet in communication therebetween. At least one flow regulator is disposed in at least one outlet that regulates the at least one fluid flow path of the at least two fluid flow paths in response to the air flow through the heat exchanger to achieve a substantially equal temperature of a fluid flowing in the at least two flow paths.

Another embodiment is directed to a heat exchanger having at least two fluid flow paths cooled by a flow of air from an air moving device through the multichannel heat exchanger. Each of the at least two fluid flow paths have an inlet and an outlet in communication therebetween. At least one flow regulator is disposed in at least one outlet. The at least one flow regulator regulates at least one fluid flow path of the at least two fluid flow paths in response to the air flow through the heat exchanger to achieve a substantially equal temperature of a fluid flowing in the at least two flow paths.

Yet another embodiment is directed to a heat exchanger having a multichannel heat exchanger. The multichannel heat exchanger has at least two fluid flow paths cooled by a flow of air from an air moving device through the multichannel heat exchanger. Each of the at least two fluid flow paths has an inlet and an outlet in communication therebetween. At least one flow regulator is disposed in at least one outlet to regulate the at least one fluid flow path of the at least two fluid flow paths in response to the air flow through the heat exchanger to achieve a substantially equal temperature of a fluid flowing in the at least two flow paths.

Still another embodiment is directed to an HVAC&R system having a compressor, a heat exchanger, an expansion valve and a multichannel heat exchanger connected in a closed refrigerant loop. The multichannel heat exchanger includes an inlet manifold that receives discharge vapor refrigerant from the compressor. The inlet manifold is divided into discrete sections and wherein each section further includes an inlet port. At least one outlet manifold discharges refrigerant fluid from the multichannel heat exchanger. The at least one outlet manifold is divided into discrete sections corresponding to the discrete sections formed in the inlet manifold, and each section also includes an outlet port. A plurality of conduits connects the inlet manifold to the at least one outlet manifold, and each of the plurality of conduits further includes a plurality of multichannels formed therealong. A pressure reducing means is connected to or formed integrally with the at least one outlet manifold. The pressure reducing means regulates the flow of refrigerant fluid through the at least one outlet manifold in relation to the flow of discharge vapor through the multichannel heat exchanger.

Yet another embodiment includes an HVAC&R system having a compressor, a heat exchanger, an expansion valve and a multichannel heat exchanger connected in a closed refrigerant loop. The multichannel heat exchanger has an inlet manifold to receive discharge vapor refrigerant from the compressor. The inlet manifold is divided into discrete sections and each section further includes an inlet port. At least one outlet manifold discharges refrigerant fluid from the multichannel heat exchanger and the at least one outlet manifold is divided into discrete sections corresponding to the discrete sections formed in the inlet manifold. Each section further includes an outlet port. A plurality of conduits connects the inlet manifold to the at least one outlet manifold. Each of the plurality of conduits further includes a plurality of multichannels formed therealong and a pressure reducing means is connected to or formed integrally with the at least one outlet manifold to regulate the flow of refrigerant fluid through the at least one outlet manifold in relation to the flow of discharge vapor through the multichannel heat exchanger.

DETAILED DESCRIPTION OF THE EXEMPLARY EMBODIMENTS

Figure 1:
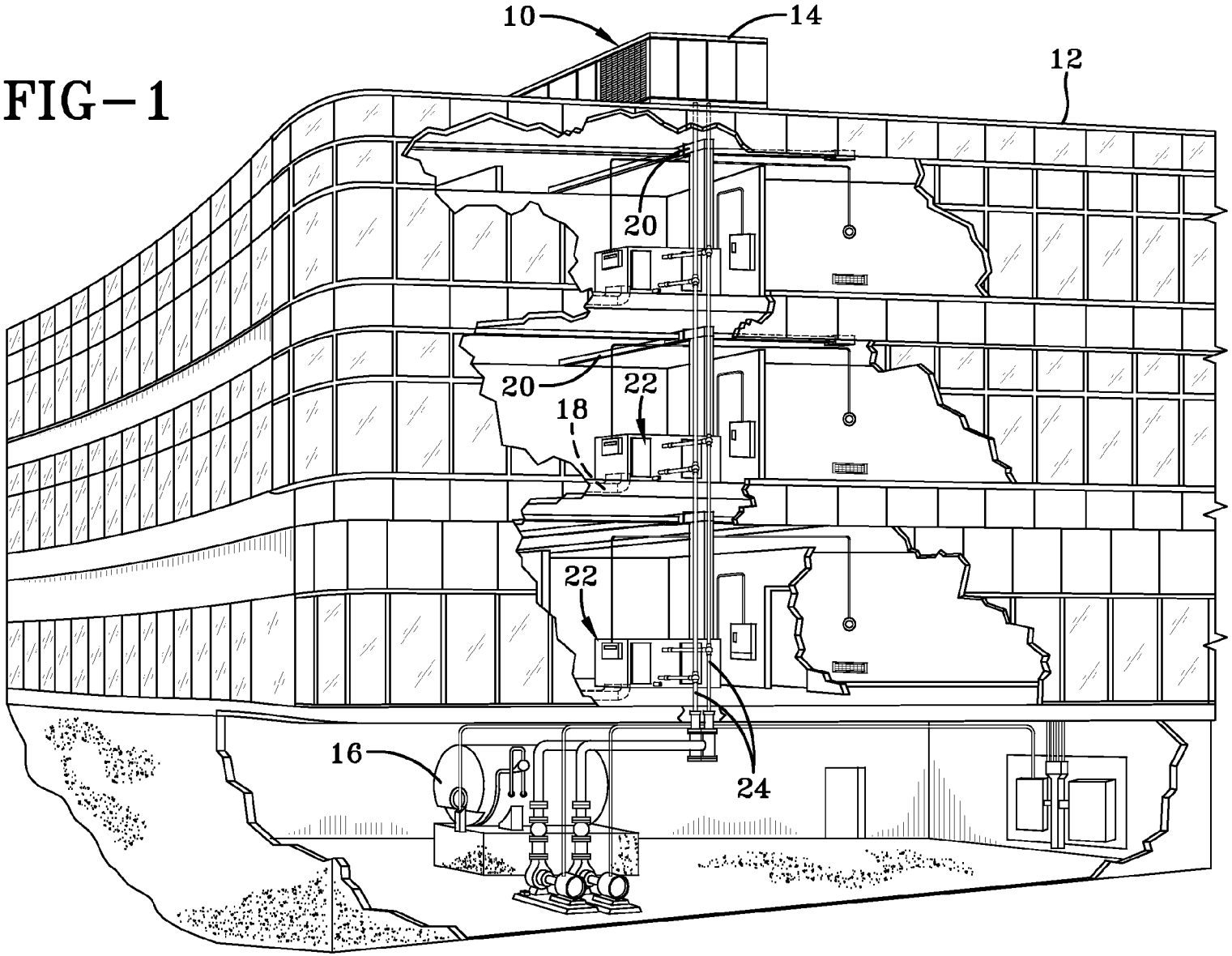
FIG. 1 shows an exemplary embodiment of an HVAC&R system in a commercial environment.

Referring to FIG. 1, an exemplary environment for an HVAC&R system 10 in a building 12 for a typical commercial setting is shown. HVAC&R system 10 may include a compressor incorporated into a rooftop unit 14 that may supply a chilled liquid that may be used to cool building 12. HVAC&R system 10 may also include a boiler 16 to supply a heated liquid that may be used to heat building 12, and an air distribution system that circulates air through building 12. The air distribution system may include an air return duct 18, an air supply duct 20 and an air handler 22. Air handler 22 may include a heat exchanger (not shown) that is connected to boiler 16 and rooftop unit 14 by conduits 24. The heat exchanger (not shown) in air handler 22 may receive either heated liquid from boiler 16 or chilled liquid from rooftop unit 14 depending on the mode of operation of HVAC&R system 10. HVAC&R system 10 is shown with a separate air handler 22 on each floor of building 12. Several air handlers 22 may service more than one floor, or one air handler may service all of the floors.

Figure 2:
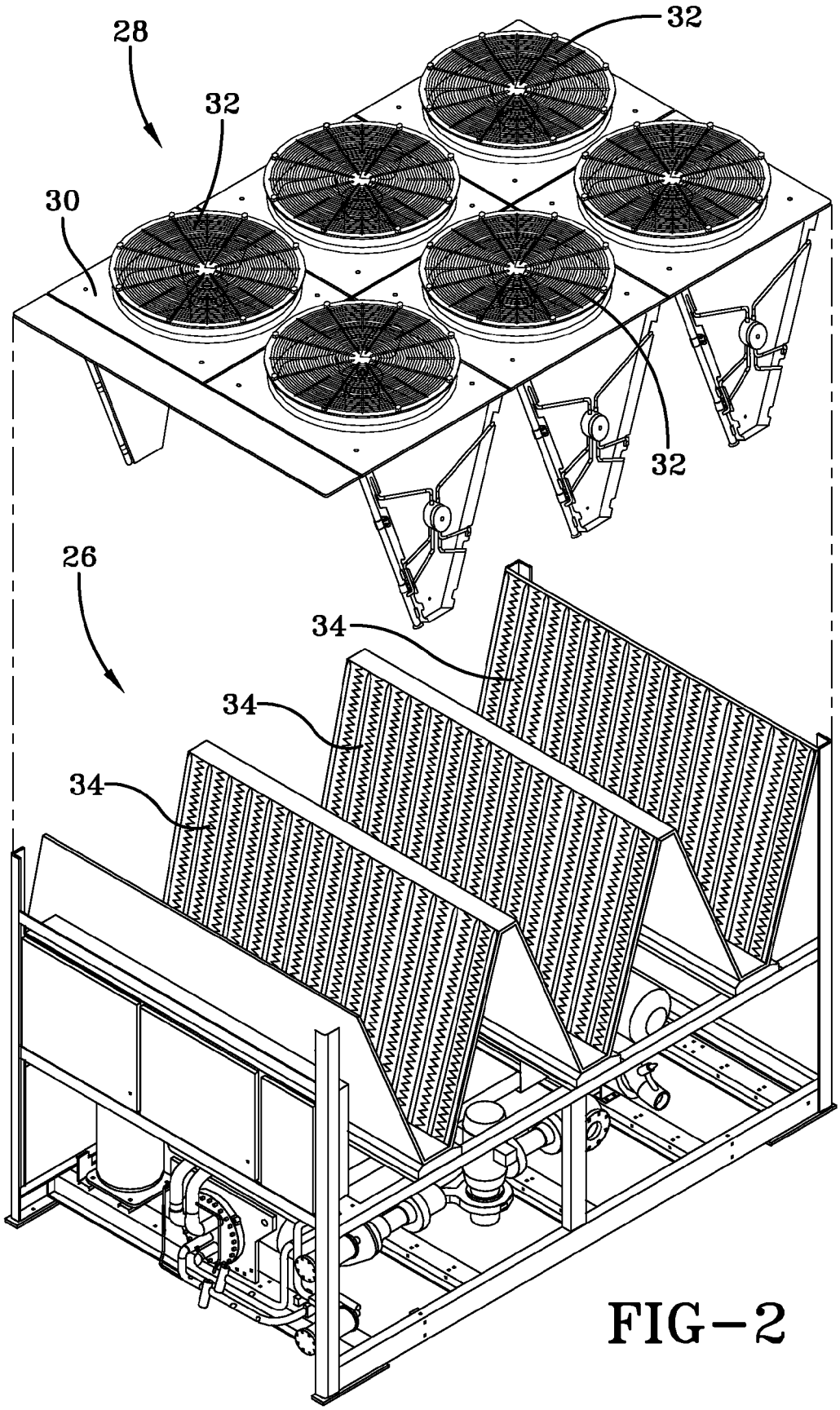
FIG. 2 shows a partially exploded view of an exemplary embodiment of a heat exchanger that may be used in the HVAC&R system shown in FIG. 1.

FIG. 2 illustrates a partially exploded view of an exemplary heat exchanger 26 that may be used in the exemplary HVAC&R system shown in FIG. 1. Heat exchanger 26 may include an upper assembly 28 including a shroud 30 one or more fans 32. The heat exchanger coils 34 may be disposed beneath shroud 30 and may be disposed above or at least partially above other system components, such as a compressor (not shown), an expansion device (not shown), and a control circuit (not shown). Coils 34 may be positioned at any angle between zero degrees and ninety degrees to provide enhanced airflow through coils 34 and to assist with the drainage of liquid from coils 34.

Figure 3:
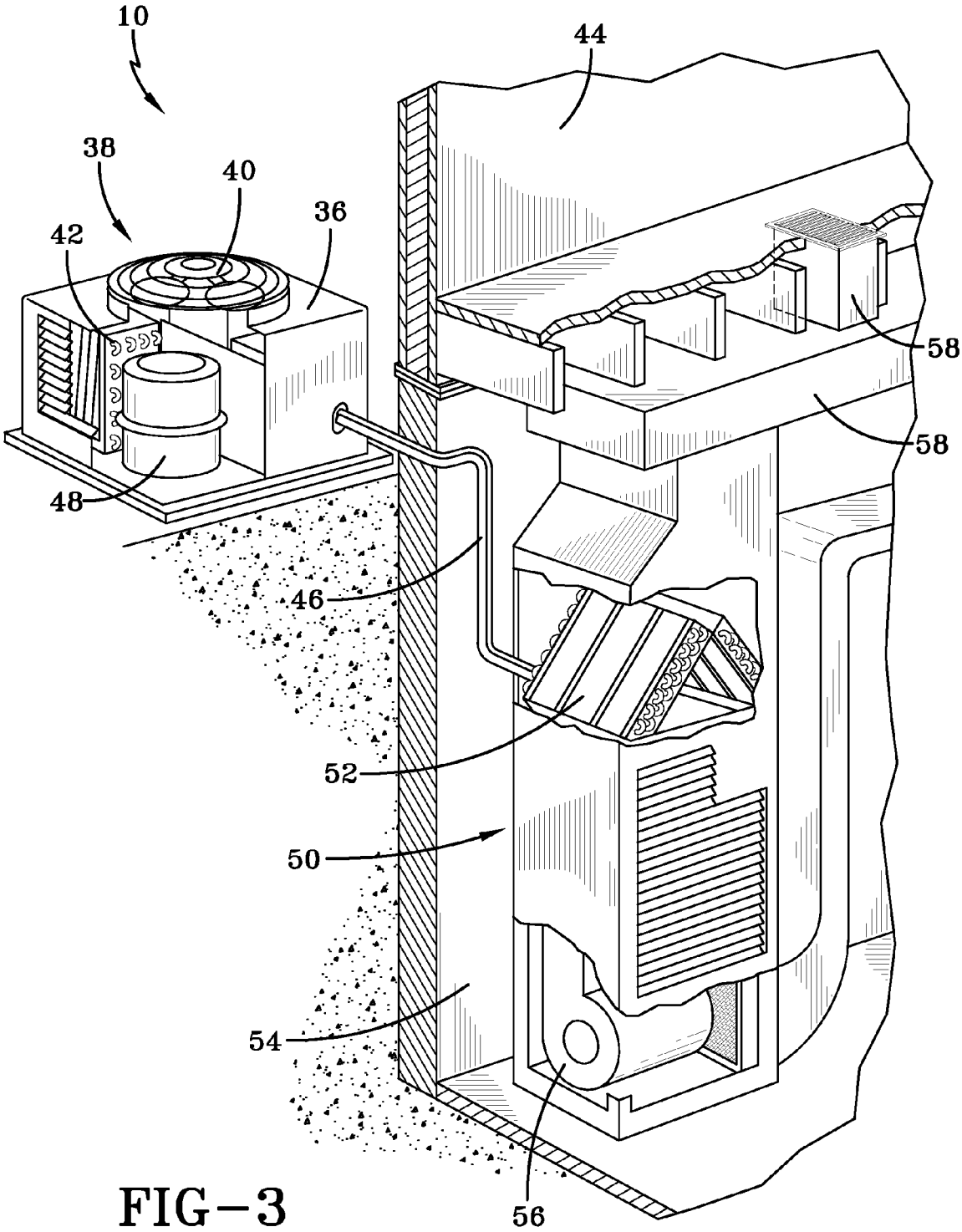
FIG. 3 shows an exemplary embodiment of an HVAC&R system in a residential environment.

Referring to FIG. 3, an exemplary environment for an HVAC&R system 10 for a typical residential setting is shown. HVAC&R system 10 may include an outdoor unit 38 located outside of a residence 44 and an indoor unit 0 located inside residence 44. Outdoor unit 38 may include a fan 40 that draws air across coils 42 to exchange heat with refrigerant in coils 42 before the refrigerant enters the residence 44 through lines 46. A compressor 48 may also be located in outdoor unit 38. Indoor unit 50 may include a heat exchanger 52 to provide cooling or heating to residence 44 depending on the operation of HVAC&R system 10. Indoor unit 50 may be located in the basement 54 of residence 44 or indoor unit 50 may be disposed in any other suitable location such as the first floor in a closet (not shown) of residence 44. HVAC&R system 10 may include a blower 56 and air ducts 58 to distribute the conditioned air (either heated or cooled) through residence 44. A thermostat (not shown) or other control may be used to control and operate HVAC&R system 10.

Figure 4:
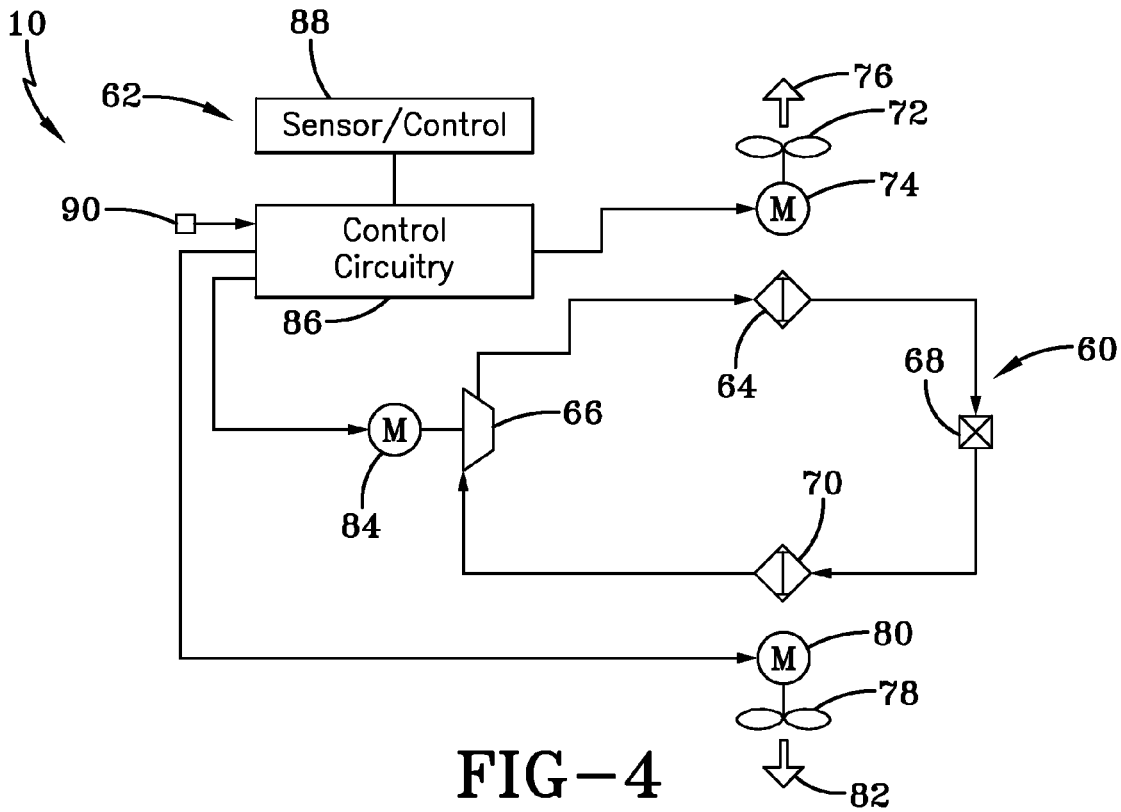
FIG. 4 schematically illustrates an exemplary HVAC&R system.

FIG. 4 illustrates an exemplary HVAC&R system 10. Refrigerant flows through HVAC&R system 10 within closed refrigerant loop 60. The refrigerant may be any fluid that absorbs and extracts heat. Some examples of fluids that may be used as refrigerants are hydrofluorocarbon (HFC) based refrigerants (for example, R-410A, R-407, or R-134a), carbon dioxide (R-744), or ammonia (R-717). HVAC&R system 10 includes control devices 62 which may enable HVAC&R system 10 during operation.

HVAC&R system 10 circulates refrigerant within closed refrigeration loop 60 through a compressor 66, a condenser 64, an electronic expansion device 68, and an evaporator 70. Compressed refrigerant vapor enters condenser 64 and flows through condenser 64. A fan 72, which is driven by a motor 74, circulates air across condenser 64. Fan 72 may push or pull air across condenser 64. The refrigerant vapor exchanges heat with the air 76 and condenses into a liquid. The liquid refrigerant then flows into expansion device 68, which lowers the pressure of the refrigerant. Expansion device 68 may be a thermal expansion valve (TXV) or any other suitable expansion device, orifice or capillary tube. After the refrigerant exits expansion device 68, some vapor refrigerant may be present along with the liquid refrigerant.

From expansion device 68, the refrigerant enters evaporator 70. A fan 78, which is driven by a motor 80, circulates air across evaporator 70. Liquid refrigerant in evaporator 70 absorbs heat from the circulated air and undergoes a phase change to a refrigerant vapor. Fan 78 may be replaced by a pump, which draws fluid across evaporator 70.

The refrigerant vapor then flows to compressor 66. Compressor 66 reduces the volume of the refrigerant vapor and increases the pressure and temperature of the vapor refrigerant. Compressor 66 may be any suitable compressor such as a screw compressor, reciprocating compressor, rotary compressor, swing link compressor, scroll compressor, or turbine compressor. Compressor 66 is driven by a motor 84, which receives power from a variable speed drive (VSD) or an alternating current (AC) or direct current (DC) power source. In an exemplary embodiment, motor 84 receives fixed line voltage and frequency from an AC power source. In some applications, the motor may be driven by a variable voltage or frequency drive. The motor may be a switched reluctance (SR) motor, an induction motor, an electronically commutated permanent magnet motor (ECM), or any other suitable motor type.

The operation of HVAC&R system 10 is controlled by control devices 62. Control devices 62 include control circuitry 86, a sensor 88, and a temperature sensor 90. Control circuitry 86 is coupled to motors 74, 80 and 84, which drive condenser fan 72, evaporator fan 78 and compressor 66, respectively. Control circuitry 86 uses information received from sensor 88 and temperature sensor 90 to determine when to operate motors 74, 80 and 84. For example, in a residential air conditioning system, sensor 88 may be a programmable twenty-four volt thermostat that provides a temperature set point to control circuitry 86. Sensor 90 may determine the ambient air temperature and provide the temperature to control circuitry 86. Control circuitry 86 may compare the temperature value received from the sensor to the temperature set point received from the thermostat. If the temperature value from the sensor is higher than the temperature set point, control circuitry 86 may turn on motors 74, 80 and 84, to operate HVAC&R system 10. Additionally, control circuitry 86 may execute hardware or software control algorithms to regulate HVAC&R system 10. Control circuitry 86 may include an analog to digital (A/D) converter, a microprocessor, a non-volatile memory, and an interface board. Other devices may be included in HVAC&R system 10, such as additional pressure and/or temperature transducers or switches that sense temperatures and pressures of the refrigerant, the heat exchangers, the inlet, and outlet air.

Figure 5:
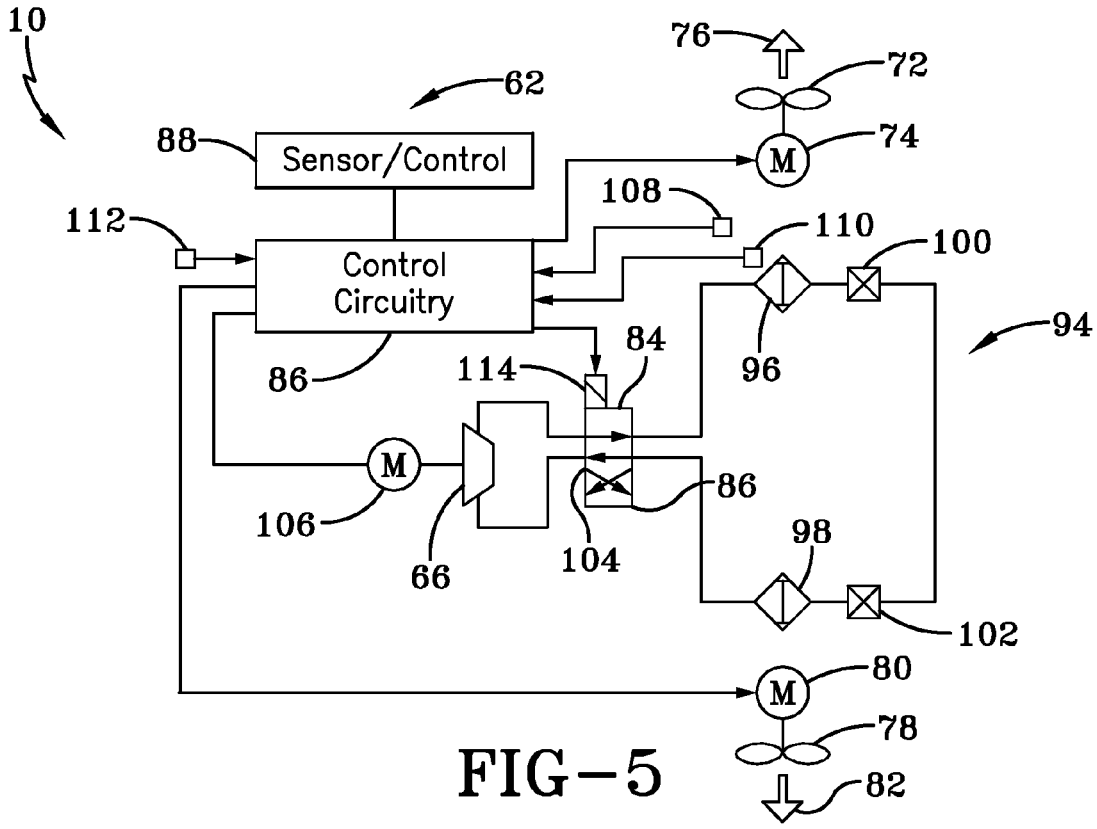
FIG. 5 schematically illustrates another exemplary HVAC&R system.

FIG. 5 illustrates an exemplary HVAC&R system 10, operating in a heat pump system capable of a heating mode of operation or a cooling mode of operation. Refrigerant flows through a reversible loop 94 in HVAC&R system 10. The refrigerant may be any fluid that absorbs and extracts heat. Additionally, operation of HVAC&R system is regulated by control devices 62.

HVAC&R system 10 includes an outdoor coil 96 and an indoor coil 98 that operate as heat exchangers. As noted above, the coils 96 and 98 may function as an evaporator or a condenser depending on the operational mode of HVAC&R system 10. For example, when system 10 is operating in a cooling (or air conditioning) mode, outdoor coil 96 functions as a condenser, releasing heat to the outside air, while indoor coil 98 functions as an evaporator, absorbing heat from the inside air. When HVAC&R system 10 is operating in a heating mode, outdoor coil 96 functions as an evaporator, absorbing heat from the outside air, while indoor coil 98 functions as a condenser, releasing heat to the inside air. A reversing valve 104 is positioned in reversible loop 94 between coils 96 and 98 to control the direction of refrigerant flow from compressor 66 and to switch HVAC&R system 10 between heating mode and cooling mode.

HVAC&R system 10 also includes two metering devices 100 and 102 for decreasing the pressure and temperature of the refrigerant before the refrigerant enters the heat exchanger operating as the evaporator. Metering devices 100 and 102 regulate refrigerant flow into the evaporator so that the amount of refrigerant entering the evaporator equals the amount of refrigerant exiting the evaporator. Metering devices 100 and 102 are used depending on the operational mode of HVAC&R system 10. For example, when HVAC&R system 10 is operating in a cooling mode, metering device 100 does not monitor the refrigerant as the refrigerant flows through metering device 100 and on to metering device 102. Metering device 102 monitors the refrigerant before the refrigerant enters indoor coil 98, which operates as an evaporator. When HVAC&R system 10 is operating in heating mode, metering device 102 does not monitor the refrigerant as the refrigerant flows through metering device 102. Metering device 100 monitors the refrigerant as the refrigerant flows from indoor coil 98 to outdoor coil 96. A single metering device may be used for both heating mode and cooling mode. Metering devices 100 and 102 typically are TXVs, but may be any suitable expansion device, orifice or capillary tubes.

In a heating mode of operation, the evaporator is outdoor coil 96 and in a cooling mode of operation, the evaporator is the indoor coil 98. Vapor refrigerant may be present in the refrigerant as a result of the expansion process that occurs in metering device 100 and 102. The refrigerant flows through the evaporator and absorbs heat from the air and undergoes a phase change into a vapor. In addition, the air passing over the evaporator may be dehumidified. The moisture from the air may be removed by condensing on the outer surface of the tubes. After exiting the evaporator, the refrigerant passes through reversing valve 104 and flows into compressor 66.

From compressor 66, the vapor refrigerant flows into a condenser. In cooling mode of operation, the condenser is the outdoor coil 96, and in the heating more of operation, the condenser is the indoor coil 98. In the cooling mode of operation, an air moving device, such as a fan 72, is powered by a motor 74 and circulates air over the condenser. The heat from the refrigerant is transferred to the outside air causing the refrigerant to undergo a phase change into a liquid. In heating mode of operation, a fan 78 is powered by a motor 80 and circulates air over the condenser. The heat from the refrigerant is transferred to the inside air causing the refrigerant to undergo a phase change into a liquid.

After exiting the condenser, the refrigerant flows through the metering device (100 in heating mode and 102 in cooling mode) and returns to the evaporator (outdoor coil 96 in heating mode and indoor coil 98 in cooling mode) where the process begins again. In both heating and cooling modes of operation, a motor 106 drives compressor 66 and compressor 66 circulates refrigerant through the reversible loop 94. Motor 106 may receive power either directly from an AC or DC power source or from a VSD.

Operation of motor 106 is controlled by control circuitry 86. Control circuitry 86 receives information from a sensor 88 and sensors 108, 110 and 112 and uses the information to control the operation of HVAC&R system 10 in both cooling mode and heating mode. For example, in cooling mode, sensor 88 may be a thermostat and may provide a temperature set point to control circuitry 86. Sensor 112 measures the ambient indoor air temperature and communicates the indoor air temperature level to control circuitry 86. If the air temperature is above the temperature set point, the HVAC&R system may operate in the cooling mode of operation. Control circuitry 86 may compare the air temperature to the temperature set point and engage compressor motor 106 and fan motors 74 and 80 to operate the HVAC&R system in a cooling mode. If the air temperature is below the temperature set point, the HVAC&R system may operate in the heating mode of operation. Control circuitry 86 may compare the air temperature from sensor 112 to the temperature set point from sensor 88 and engage motors 74, 80 and 106 to operate the HVAC&R system 10 in a heating mode.

Control circuitry 86 may use information received from sensor 88 to switch HVAC&R system 10 between heating mode and cooling mode. For example, if sensor 88 is set to cooling mode, control circuitry 86 may send a signal to a solenoid 82 to place reversing valve 104 in the air conditioning or cooling position. The refrigerant may then flow through reversible loop 94 as follows. The refrigerant exits compressor 66 and flows to outdoor coil 96, which is operating as a condenser. The refrigerant is then expanded by metering device 102, and flow to indoor coil 98, which is operating as an evaporator. If sensor 88 is set to heating mode of operation, control circuitry 86 may send a signal to solenoid 82 to place reversing valve 104 in the heating position. The refrigerant may then flow through reversible loop 94 as follows. The refrigerant exits compressor 66 and flows to indoor coil 98, which is operating as an evaporator. The refrigerant is then expanded by metering device 100, and flows to outdoor coil 96, which is operating as a condenser. Control circuitry 86 may execute hardware or software control algorithms to regulate HVAC&R system 10. Control circuitry 86 may include an A/D converter, a microprocessor, a non-volatile memory, and an interface board.

Control circuitry 86 also may initiate a defrost cycle for outside coil 96 when HVAC&R system 10 is operating in heating mode. When the outdoor temperature approaches freezing, that is, thirty-two deg. F., moisture in the outside air that is directed over outdoor coil 96 may condense and then freeze on the coil. Sensor 108 measures the outside air temperature, and sensor 110 measures the temperature of outdoor coil 96. The temperature information gathered by sensors 108 and 110 are provided to control circuitry 86, which determines when to initiate a defrost cycle for outdoor coil 96. For example, if sensor 108 or sensor 110 provides a temperature below freezing to the control circuitry, system 10 may initiate a defrost cycle for outdoor coil 96. In a defrost cycle, solenoid 82 is actuated to place reversing valve 104 to air conditioning position, and motor 74 is shut off to discontinue airflow over outside coil 96. HVAC&R system 10 operates in cooling mode until the "warm" refrigerant from compressor 66 defrosts outdoor coil 96. Once sensor 110 detects that outdoor coil 96 is defrosted by monitoring a parameter of outdoor coil 96, such as the temperature, control circuitry 86 returns reversing valve 104 to heating position. The defrost cycle may also be set to occur at various predetermined time and temperature combinations with or without relying on sensors 108 and 110.

Figure 6:
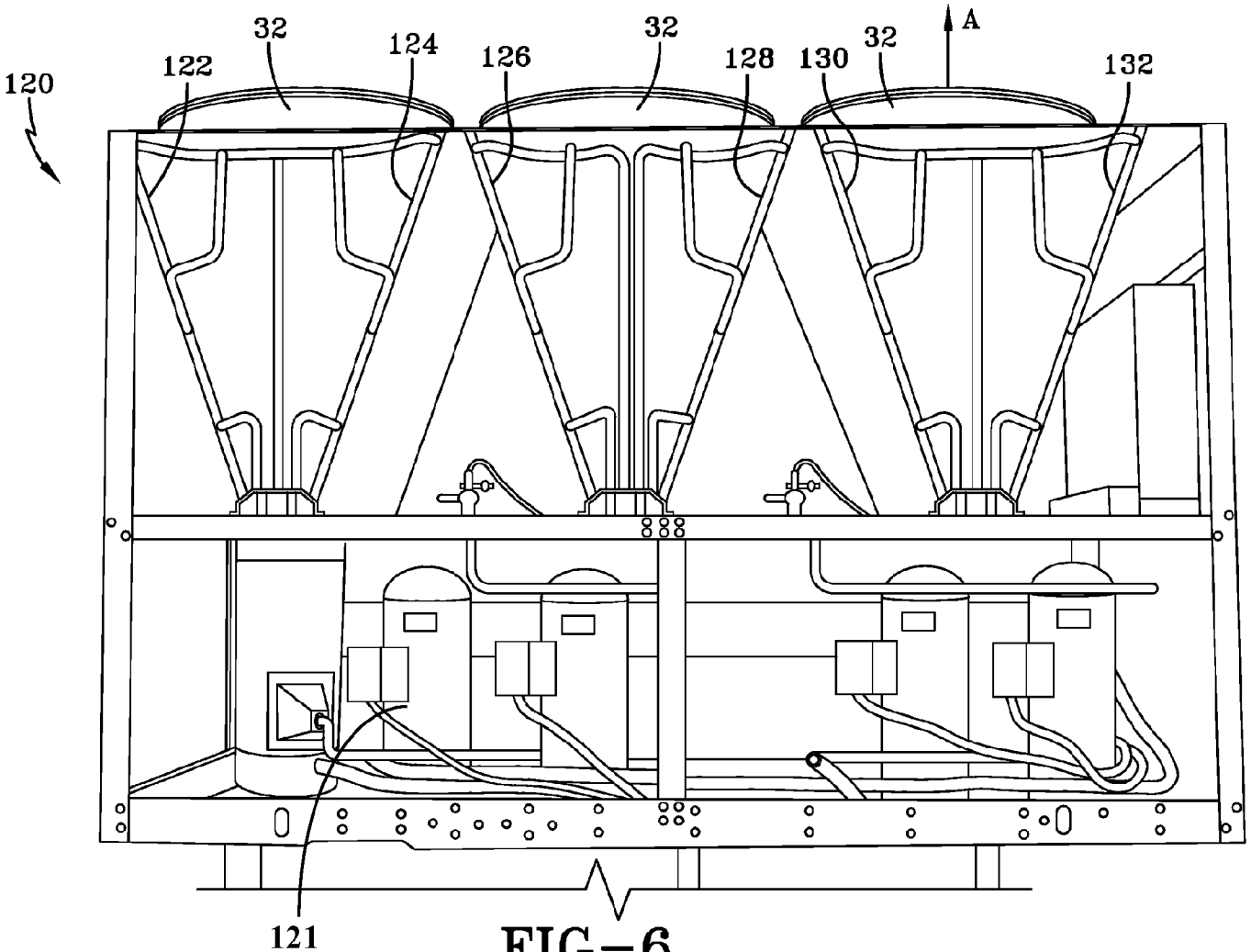
FIG. 6 shows an end view of an exemplary embodiment of a heat exchanger that may be used in the HVAC&R system shown in FIG. 1.

FIG. 6 shows an end view of an exemplary embodiment of heat exchanger 26 in FIG. 2. Heat exchanger 26 may include at least one compressor 121, a condenser (120 opposite the end shown in FIG. 2), at least one expansion device (not shown), at least one evaporator (not shown), and controls (not shown). Two or more compressors 121 may be connected as part of refrigerant circuits. For systems with scroll compressors, two or three compressors may be used in each circuit to provide capacity control and to achieve a larger system capacity than may be available with a single compressor. Two or more refrigerant circuits may be used with air-cooled chillers to allow for continued cooling in the event of a component failure in one refrigerant circuit. Multiple refrigerant circuits may also allow for chiller capacities with more than three scroll compressors in a single circuit. Alternately, multiple refrigerant circuits may be employed instead of increasing the number of compressors beyond three or four in a single circuit.

At least one blower unit or fan 32 draws air into condenser 120 and exhausts air from condenser 120 in direction A. In this exemplary embodiment, condenser 120 includes six fans 32. More or less than six fans 32 of varying size and configuration may be used as determined by the cooling demand of condenser 120. Condenser 120 includes end panels (not shown) and a bottom panel (not shown) to assist in channeling substantially all of the cooling air drawn into condenser 120 by fan 32 through coils 122, 124, 126, 128, 130, and 132.

Figure 7:
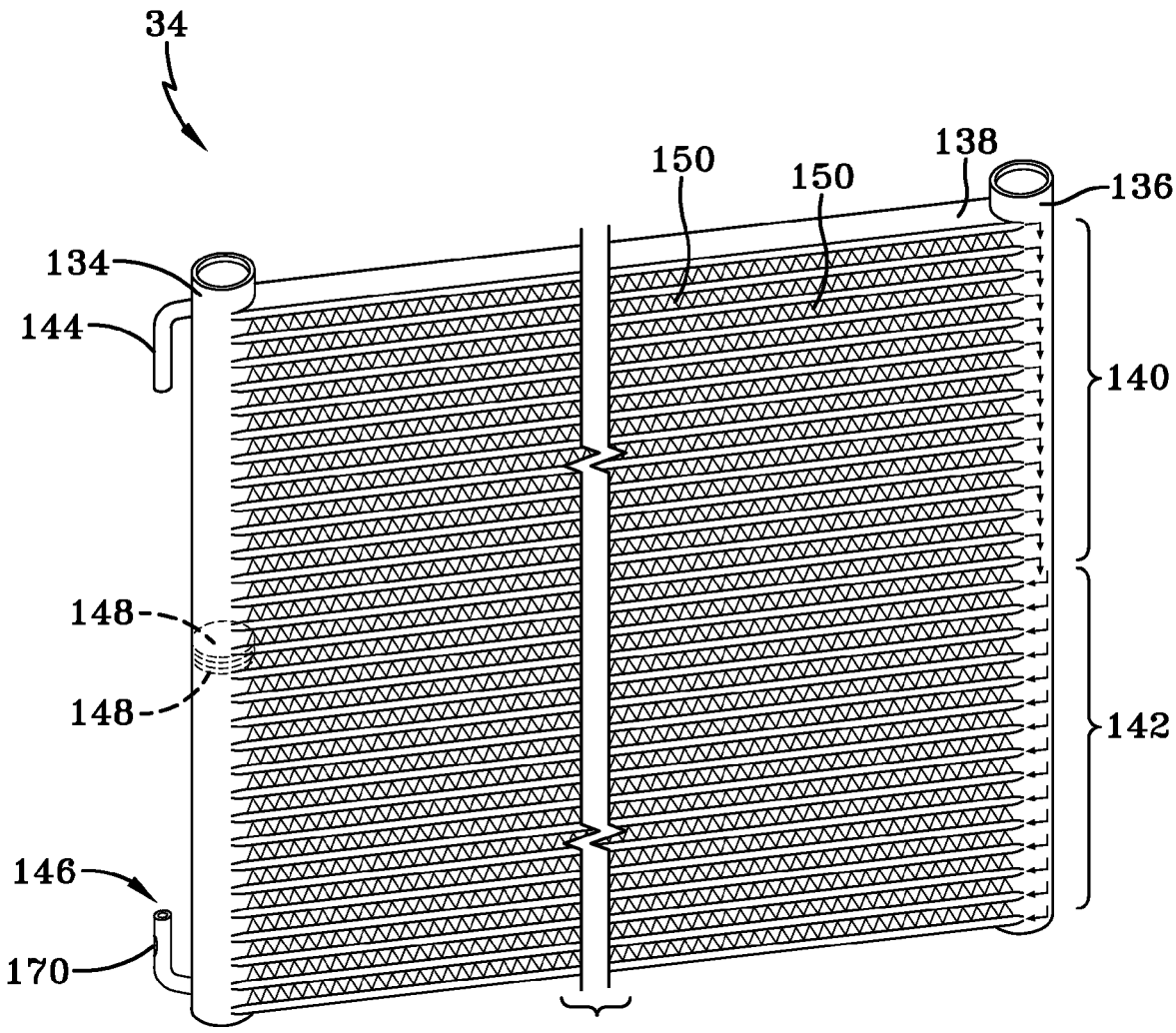
FIG. 7 shows an exemplary multichannel heat exchanger.

FIG. 7 shows an exemplary multichannel heat exchanger coil 34, which may be used in HVAC&R system 10. Multichannel heat exchanger 34 may be used in condenser 64, evaporator 70, outside coil 96, or inside coil 98, as shown in FIGS. 4 and 5. Multichannel heat exchanger 34 may also be used as part of a chiller system or in any other heat exchanging application. Multichannel heat exchanger 34 may include headers or manifolds 134, 136 that are connected by multichannel tubes 138. Although thirty multichannel tubes 138 are shown in FIG. 7, the number of tubes 138 may vary. Manifolds 134, 136 and tubes 138 may be constructed of aluminum or any other suitable material that promotes heat transfer. Refrigerant may flow from manifold 134 through a predetermined amount of first tubes 140 to manifold 136. The refrigerant may return to manifold 134 through a predetermined number of second tubes 142. Multichannel heat exchanger 34 may be rotated approximately ninety degrees so that multichannel tubes 138 run vertically between a top manifold and a bottom manifold. Multichannel heat exchanger 34 may be inclined at any angle. Multichannel tubes 138 are shown as having an oblong shape in FIGS. 7 and 8, though tubes 138 may be any suitable shape, such as tube 138 with a cross-section in the form of a rectangle, square, circle, oval, ellipse, triangle, trapezoid, parallelogram or other closed geometry. Tubes 138 may have a width ranging from about 0.5 millimeters (mm) to about 3 mm. Multichannel heat exchanger 34 may be provided in a single plane or slab, or may include bends, corners, and/or contours.

In some embodiments, the construction of first tubes 140 may differ from the construction of second tubes 142. Tubes 138 may also differ within each section. For example, tubes 138 may all have identical cross-sections, or first tubes 140 may be rectangular while second tubes 142 may be oval or vice versa. The internal construction of tubes 138 may also vary within and across the length of each tube 138.

Refrigerant enters heat exchanger 34 through an inlet 144 located in manifold 134 and exits heat exchanger 34 through an outlet 146 located in manifold 134. Although FIG. 7 shows inlet 144 at the top of manifold 134 and outlet 146 at the bottom of manifold 134, the position of inlet 144 and outlet 146 may be interchanged so that fluid enters at the bottom and exits at the top of manifold 134. Fluid may also enter and exit manifold 134 from multiple inlets and outlets positioned on bottom, side, or top surfaces of manifold 134. Inlet 144 and outlet 146 or multiple inlets and outlets may also be disposed on manifold 136 instead of manifold 134 or in both manifolds 134, 136. Baffles 148 may separate inlet 144 and outlet 146 on manifold 134. Although a double baffle 148 is illustrated, any number of one or more baffles 148 may be used to create separation between inlet 144 and outlet 146.

Figure 8:
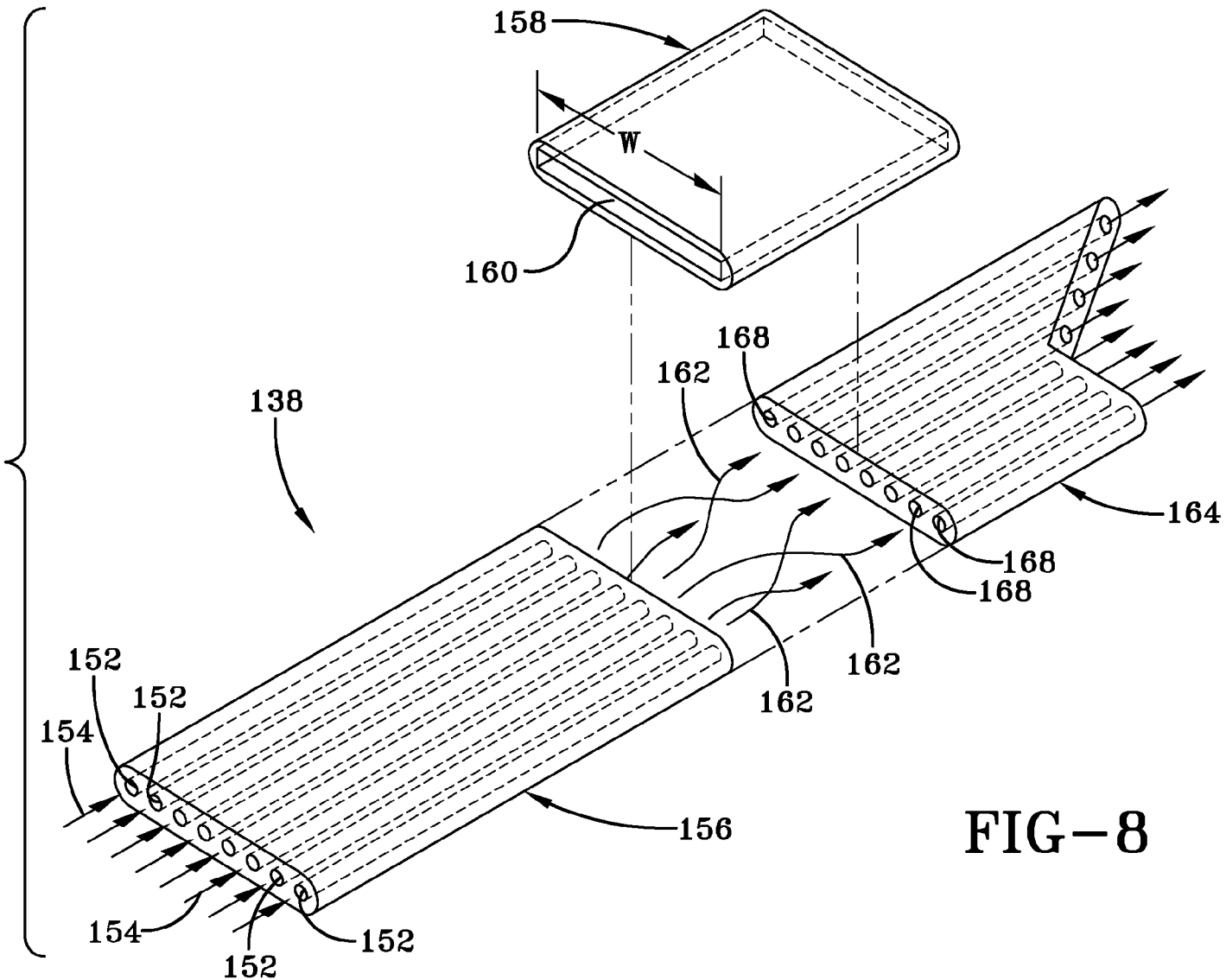
FIG. 8 shows an exemplary multichannel heat exchanger containing internal tube configurations.

Fins 150 are located between multichannel tubes 138 to promote heat transfer between tubes 138 and the environment. Fins 150 may be constructed of aluminum, may be brazed or otherwise joined to tubes 138, and disposed generally perpendicular to the flow of refrigerant. Fins 150 may also be made of other suitable materials that facilitate heat transfer and may extend parallel or at varying angles with respect to the flow of the refrigerant. Fins 150 may be louvered fins, corrugated fins, or any other suitable type of fin. In an evaporator heat exchanger application, at least a portion of the heat transfer may occur during to a phase change of the refrigerant in tubes 138. Refrigerant exits expansion device 68 (see, for example, FIG. 4) and enters evaporator 70. As the liquid travels through first multichannel tubes 140, the liquid absorbs heat from the outside environment causing the liquid to increase in temperature. As the liquid refrigerant travels through second multichannel tubes 142, the liquid absorbs more heat from the outside environment and undergoes phase change into a vapor. Although evaporator applications may use liquid refrigerant to absorb heat, some vapor may be in the evaporator. The amount of vapor may vary based on the type of refrigerant used in HVACAR system 10. FIG. 8 shows the internal flow paths of tube 138. Refrigerant flows through flow channels 152 contained within tube 138. Flow channels 152 may be parallel to one another. The direction of fluid flow 154 may be from manifold 134 to manifold 136 as shown in FIG. 7. Alternately, the direction of fluid flow may be reversed. Because the refrigerant within manifold 134 may be a mixture of liquid and vapor refrigerant, flow channels 152 may contain liquid and vapor. Additionally, because of the density difference of liquid and vapor, which causes separation of phases, some flow channels 152 within the channel section 156 may contain only vapor phase refrigerant while other flow channels 152 may contain only liquid phase refrigerant. The fluid in flow channels 152 may be refrigerant, brine, or other fluid capable of the necessary phase change.

After flowing through channel section 156, the refrigerant reaches an open section 158. In open section 158, the interior walls that form the flow channels have been removed or interrupted. Open section 158 includes an open channel 160 spanning the width W of tube 138 where mixing of the two phases of refrigerant may occur. Mixed flow 162 occurs within open section 158, causing fluid flow 162 from flow channels 154 to cross paths and mix. Flow channels containing all (or primarily) vapor phase may mix with flow channels containing all (or primarily) liquid phase, providing a more homogenous distribution of refrigerant since flow channels 152 containing only vapor phase refrigerant may not be able to absorb as much heat because the refrigerant has already changed phases. Refrigerant from flow channels containing different percentages of vapor and liquid may also mix. In an alternate embodiment, channel 160 may not span the width W of Tube 138 to not include all flow channels 152.

From open section 158, the refrigerant enters flow channels 168 contained within channel section 164. The fluid flow 166 through flow channels 168 may contain a more even distribution of vapor and liquid phases due to mixed flow 162 that occurred within open channel 160. Tube 138 may contain any number of open sections 158 where mixing may occur. Rather than allowing vapor alone to be channeled through certain flow paths, the internal wall interruptions permit mixing of the phases, allowing increased phase change to occur in all of the flow paths 152, 168 (through which an increasingly mixed phase flow will be channeled). The internal wall interruptions also allow tubes 138 to be segregated into sections for repair purposes. For example, if flow channel 152 becomes blocked, plugged, or requires repair, that section of flow channel 152 may be removed from service or bypassed while the corresponding flow channel 168 continues to receive refrigerant flow.

Referring back to FIG. 6, outer heat exchanger coils 122, 132 may have a much higher air flow than inner coils 124, 126, 128, and 130 because of the placement of the outer coils on the outside of condenser 120. Higher airflow through a coil 34 (see FIG. 7) may result in lower refrigerant liquid temperatures within flow channels 152, 158, and 168. Lowering the refrigerant liquid temperatures increases the operating efficiency of condenser 120. Airflow rates through outer coils 122, 132 may almost be double the airflow rates through inner coils 124, 126, 128, and 130. Table 1, below, provides sample refrigerant temperatures at the exit of each coil in a conventional condenser. The temperatures of each coil vary, resulting in inefficient chiller system operation.

TABLE 1

| | Coil number | | | | | |
|---|---|---|---|---|---|---|
| | 122 | 124 | 126 | 128 | 130 | 132 |
| Sample Temp. (Degrees Fahrenheit) | 96.7 | 109.4 | 103.3 | 106.3 | 113.6 | 102.6 |

Figure 9:
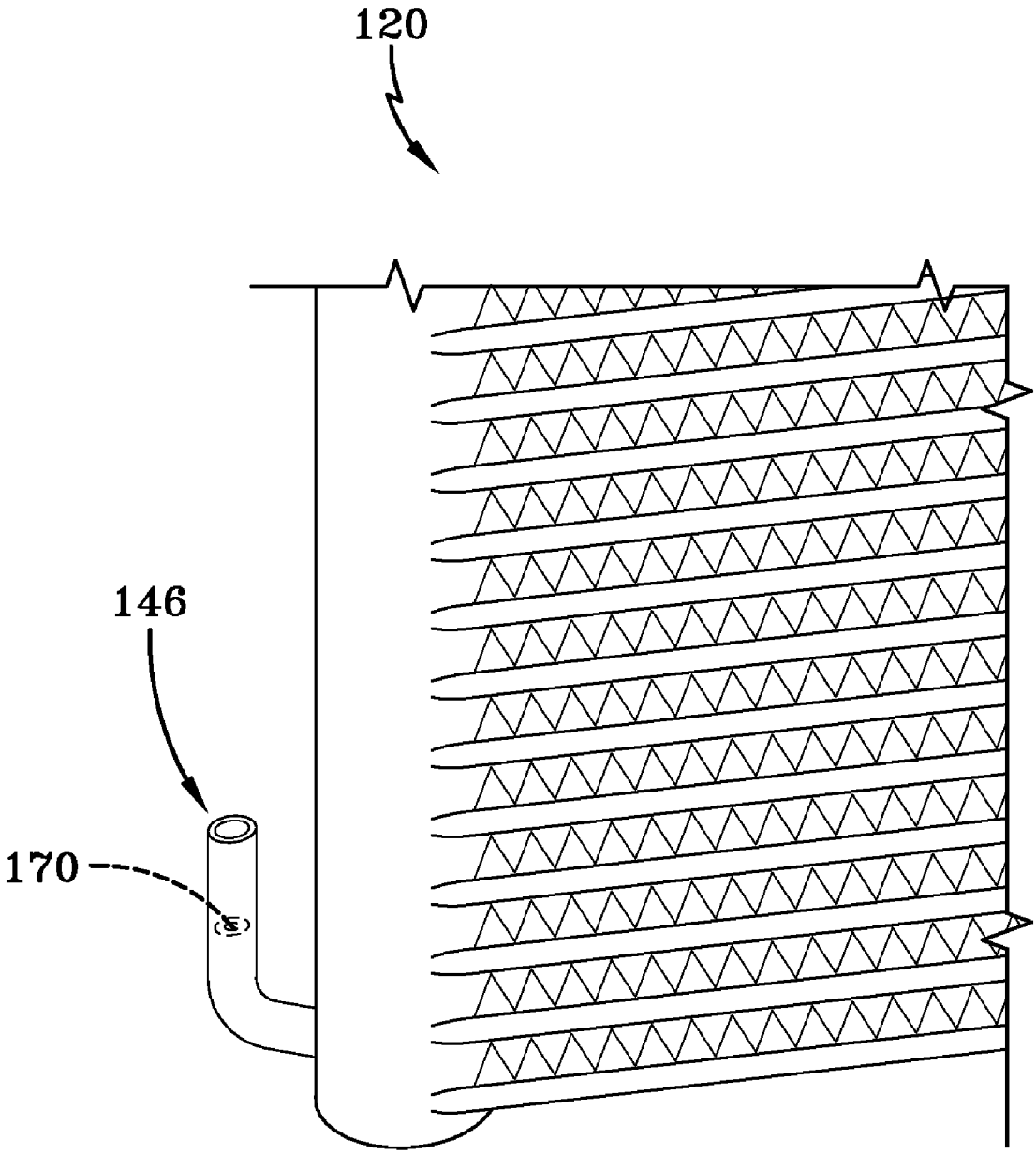
FIG. 9 shows an enlarged partial view of an exemplary multichannel heat exchanger with an orifice disposed in the outlet.

To regulate the flow of refrigerant in coils 122, 124, 126, 128, 130, and 132, a valve or orifice 170 may be disposed in outlet 146 of at least one of coils 122, 124, 126, 128, 130, and 132, which valve 170 is shown in FIG. 9. Valve or orifice 170 may provide necessary refrigerant flow for each individual coil 122, 124, 126, 128, 130, and 132, depending on the amount of airflow coil 122, 124, 126, 128, 130, and 132 receives. The refrigerant is regulated to allow the airflow to cool the refrigerant in flow channels 152, 158, and 168 (see FIG. 8) and provide a more efficient chiller system of operation. Valve or orifice 170 may restrict the refrigerant flow in flow channels 152, 158, and 168, and control the refrigerant flow. The restriction of the refrigerant flow may allow the airflow from fans 32 to provide better heat transfer to cool the refrigerant, thereby providing a lower liquid temperature in coils 122, 124, 126, 128, 130, and 132. Valve or orifice 170 may also allow more refrigerant flow, thereby providing a lower pressure drop in the corresponding liquid line of coil 122, 124, 126, 128, 130, or 132 and allowing more refrigerant to flow. A reduced line size, such as a venturi, or other flow-restricting component may be interchanged with valve or orifice 170. The sizing or positioning of valve or orifice 170 may be adjustable to obtain the desired pressure drop or the desired refrigerant liquid temperature exiting coil 122, 124, 126, 128, 130, or 132. Valve or orifice 170 may be controlled by an automatic control, using circuitry or microprocessors. Valve or orifice 170 may be controlled manually according to the amount of airflow throughout condenser 120.

One or more valves or orifices 170 may be incorporated in coils 122, 124, 126, 128, 130, or 132 as a unitary part of coil 122, 124, 126, 128, 130, or 132. Table 2, appearing below, provides sample refrigerant temperatures at the exit of coil 122, 124, 126, 128, 130, or 132 in which coils 124 and 130 include valve or orifice 170 formed in outlet 146. The temperatures of coils 122, 124, 126, 128, 130, or 132 are now closer in range and more evenly distributed, resulting in more efficient chiller system operation.

TABLE 2

| | Coil number | | | | | |
|---|---|---|---|---|---|---|
| | 122 | 124 | 126 | 128 | 130 | 132 |
| Sample Temp. (Degrees Fahrenheit) | 98.7 | 101.3 | 103.5 | 103.4 | 102.8 | 101.3 |

The incorporation of one or more valves or orifices 170 with outlet 146 of coils 122, 124, 126, 128, 130, and 132 may lower the refrigerant liquid temperature entering expansion valve 68 by approximately 1.5 deg. Fahrenheit with no change in the condensing temperature. The resulting lower liquid temperature may provide a substantially 1% increase in both chiller capacity and efficiency. Lower liquid temperature may substantially eliminate vapor from exiting at least one of coils 122, 124, 126, 128, 130, and 132. The incorporation of one or more orifices 170 with the discharge connections of coils 122, 124, 126, 128, 130, and 132 may be incorporated with multichannel and conventional channel applications with uneven air distribution. While reference has been made to using airflow for heat transfer, any suitable type of non-volatile fluid may be used, for example, water. The examples provided above in Table 1 and Table 2 may include condensers with any suitable number of multichannel coils.

Figure 10:
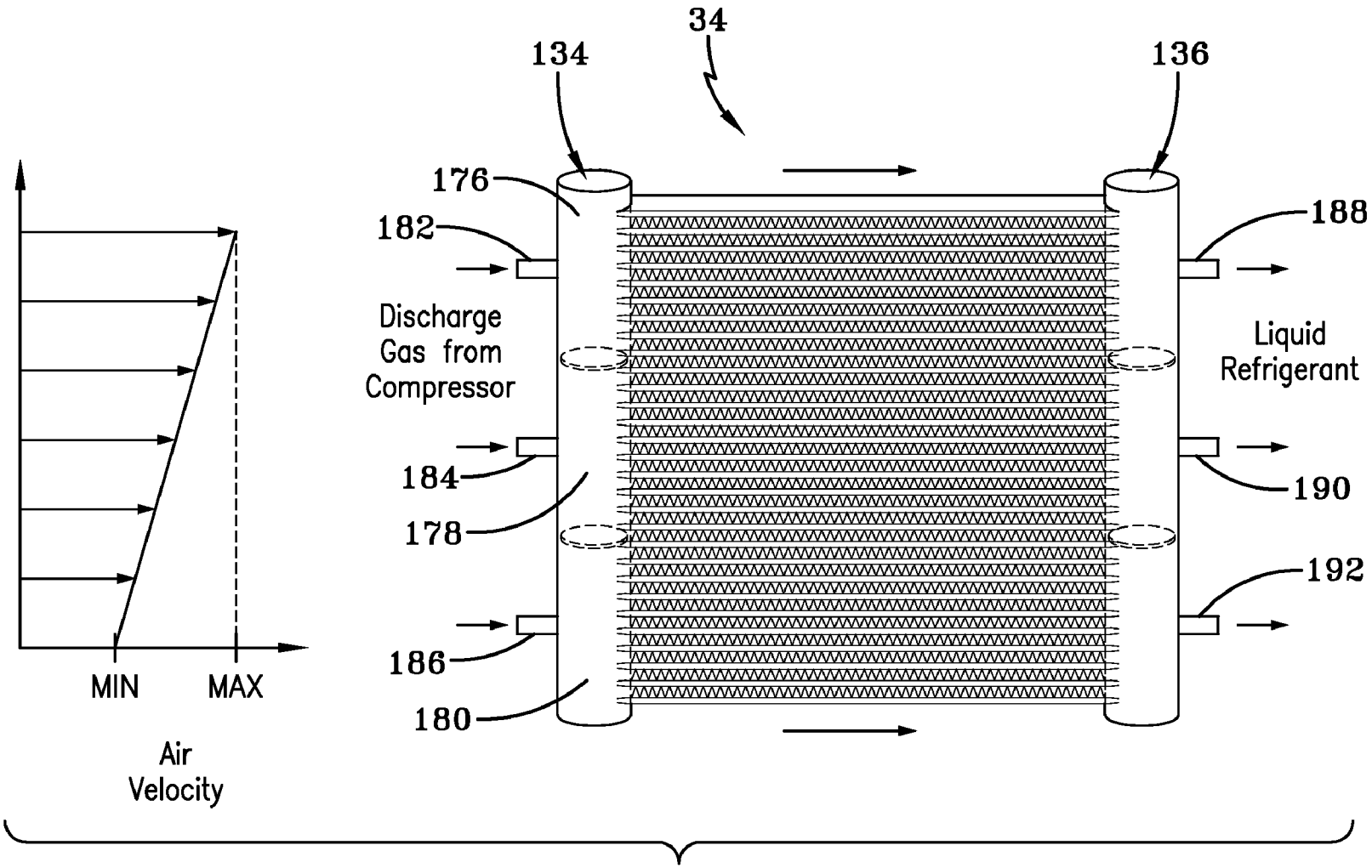
FIGS. 10 through 14 show exemplary embodiments of multichannel heat exchangers.

FIGS. 10, 11, 12, 13 and 14 show exemplary embodiments of regulating refrigerant flow in multichannel heat exchanger coil 34. Air velocity through coil 34 varies from a top 172 of coil 34 to a bottom 174 of coil 34 due to a low air pressure drop through coil 34. As shown in FIG. 10, airflow and refrigerant flow may be evenly distributed by dividing the refrigerant flow in coil 34 into multiple circuits 176, 178, 180. The flow in each circuit 176, 178, 180 may be regulated by having an inlet 182, 184, 186, respectively, formed on manifold 134, and having an outlet 188, 190, 192, respectively, formed on manifold 136.

Figure 11:
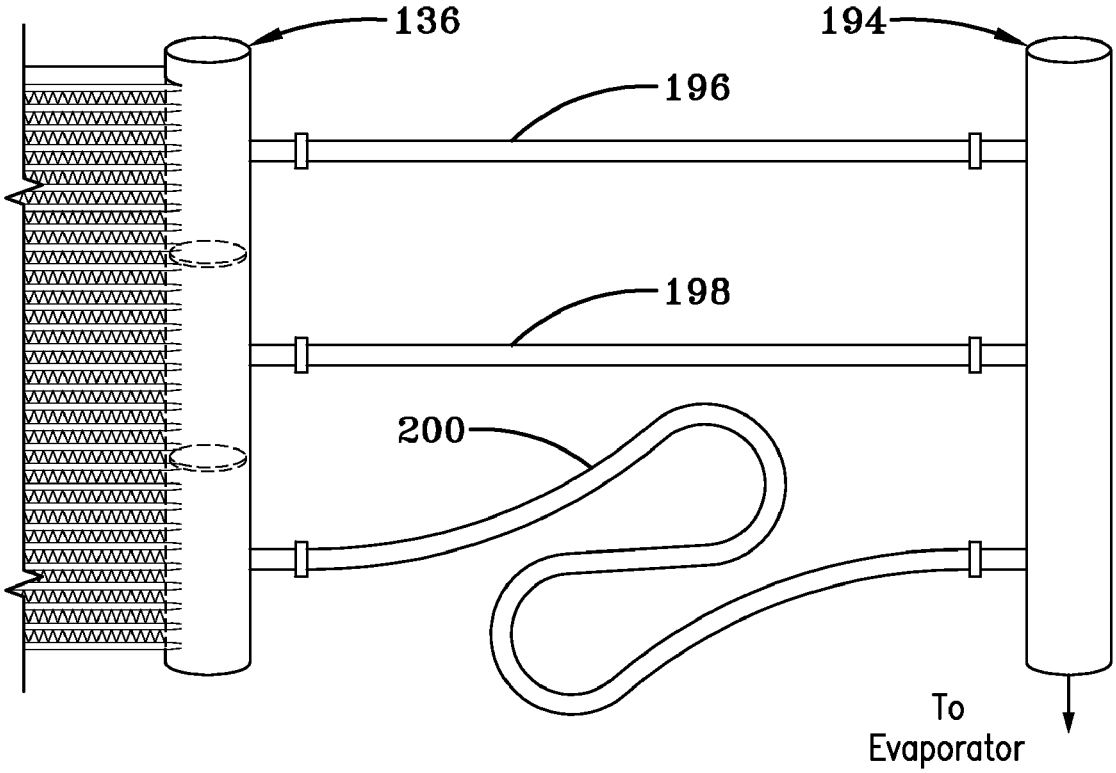
Figure 12:
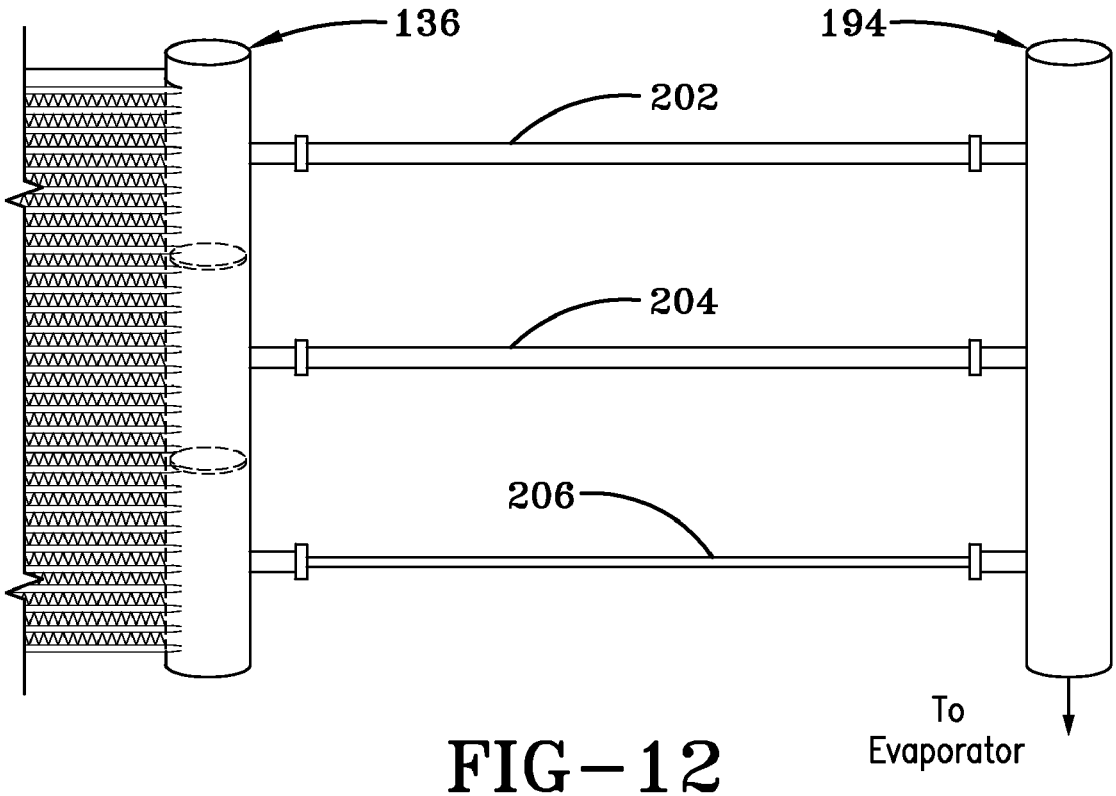
Figure 13:
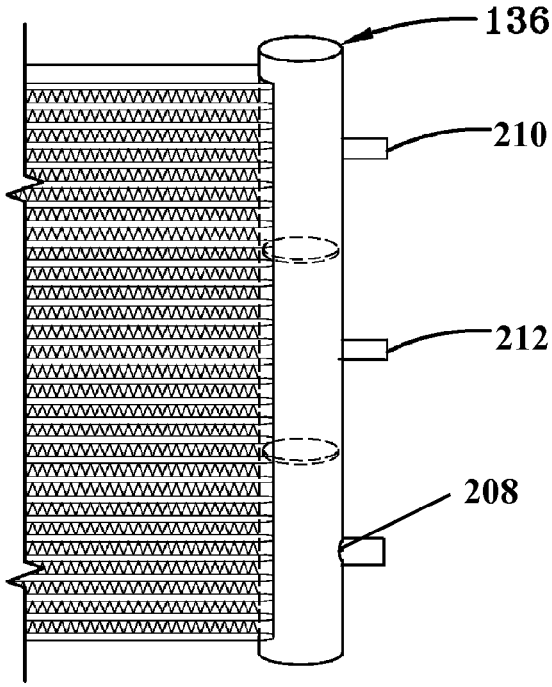
Figure 14:
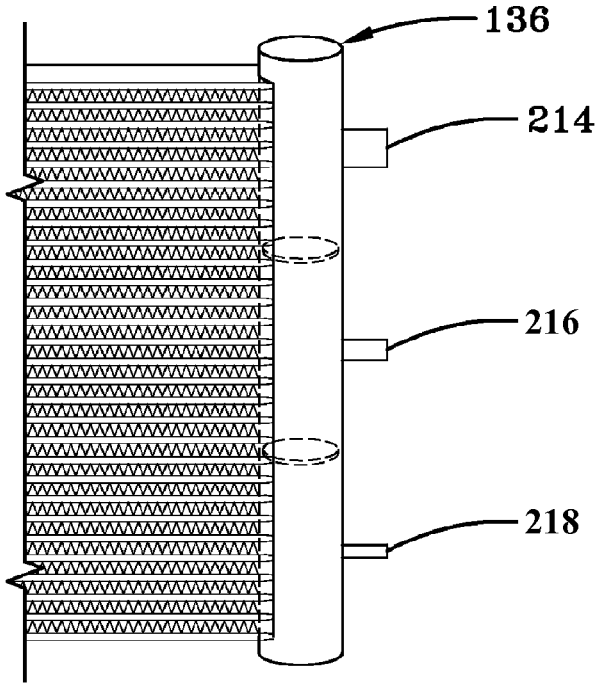

As shown in FIG. 11, a separate common manifold 194 is connected to manifold 136 by channels 196, 198, 200. A differential pressure drop is achieved by extending the length of channel 200 beyond that of channels 196 and 198. As shown in FIG. 12, separate common manifold 194 is connected to outlet manifold 136 by channels 202, 204, 206. A differential pressure drop is achieved by narrowing the diameter of channel 206 as compared to the diameter of channels 202, 204. As shown in FIG. 13, orifice 208 is provided in circuit 180 (see FIG. 10), while outlets 210, 212 are placed in circuits 176, 178 (see FIG. 10). As shown in FIG. 14, outlets 214, 216, 218 are provided with decreasing diameters as located on manifold 136. In other embodiments, a valve or other flow-restricting component in any combination may be used. The sizing of the orifice, outlets, tubing, may be adjusted to obtain a desired pressure drop (and corresponding refrigerant flow) in the stream through coil 34. The use of multiple streams in the coil 34 and corresponding pressure drops in the streams may also be used with conventional heat exchangers, for example fin and tube coils, having uneven air distribution.

While only certain features and embodiments of the invention have been illustrated and described, many modifications and changes may occur to those skilled in the art (for example, variations in sizes, dimensions, structures, shapes and proportions of the various elements, values of parameters (for example, temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (that is, those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A heating, ventilation, air conditioning and refrigeration (HVAC&R) system comprising:

a compressor, a first heat exchanger, an expansion valve, and a second heat exchanger connected in a closed refrigerant loop;

the first heat exchanger being in fluid communication with the compressor to receive refrigerant vapor from the compressor, the first heat exchanger comprising:

a plurality of coils, each coil of the plurality of coils comprising an inlet manifold, an outlet manifold and a plurality of multichannel tubes connecting the inlet manifold and the outlet manifold;

at least one air moving device, the at least one air moving device being positioned to circulate air through each coil of the plurality of coils, at least one coil of the plurality of coils receiving less airflow than the other coils of the plurality of coils;

each coil of the plurality of coils being configured to provide a flow path for refrigerant, the refrigerant flowing along the flow path in the coil being cooled by airflow from the at least one air moving device; and at least one flow regulator being positioned in an outlet manifold of the at least one coil of the plurality of coils receiving less airflow, the at least one flow regulator being operational to regulate the flow of refrigerant in the at least one coil of the plurality of coils receiving less airflow to achieve a substantially equal temperature of refrigerant exiting the outlet manifolds of the plurality of coils.

2. The HVAC&R system of claim 1 wherein the at least one flow regulator is an orifice.

3. The HVAC&R system of claim 1 wherein the at least one flow regulator is a valve.

4. The HVAC&R system of claim 1 wherein the plurality of coils comprises six coils.

5. The HVAC&R system of claim 4 wherein the at least one flow regulator is positioned in the outlet manifold of at least two of the six coils.

6. The HVAC&R system of claim 1 wherein the at least one flow regulator is of unitary construction with the outlet manifold.

7. The HVAC&R system of claim 1 wherein the at least one coil of the plurality of coils receiving less airflow has a coil of the plurality of coils positioned on opposing sides.

8. A heat exchanger comprising:

at least one air moving device;

at least two fluid flow paths, each fluid flow path of the at least two fluid flow paths being positioned to enable the fluid flowing along the fluid flow path to be cooled by a flow of air from the at least one air moving device, each of the at least two fluid flow paths having an inlet and an outlet and at least one flow path of the at least two flow paths having a lower air flow rate than the other flow paths of the at least two flow paths; and a flow regulator being positioned in the outlet of the at least one fluid flow path having a lower air flow rate, the flow regulator being operable to regulate the flow of fluid in the at least one fluid flow path having a lower air flow rate to achieve a substantially equal temperature of fluid flowing from the at least two fluid flow paths.

9. The heat exchanger of claim 8 wherein the flow regulator is an orifice.

10. The heat exchanger of claim 8 wherein the flow regulator is a valve.

11. The heat exchanger of claim 8 wherein the at least two fluid flow paths comprises at least two coils, each coil of the at least two coils corresponding to a fluid flow path.

12. The heat exchanger of claim 11 wherein the at least two coils comprises six coils.

13. The heat exchanger of claim 12 wherein the flow regulator is positioned in the outlet of two or more of the six coils.

14. The heat exchanger of claim 8 wherein the flow regulator is of unitary construction with the outlet.

15. The heat exchanger of claim 8 wherein the fluid is refrigerant.

16. An HVAC&R system comprising:

a compressor, a heat exchanger, an expansion valve and a multichannel heat exchanger connected in a closed refrigerant loop;

the multichannel heat exchanger further comprising:

an inlet manifold configured to receive discharge vapor refrigerant from the compressor, wherein the inlet manifold is divided into discrete sections and wherein each section further includes an inlet port;

at least one outlet manifold for discharging refrigerant fluid from the multichannel heat exchanger, wherein the at least one outlet manifold is divided into discrete sections corresponding to the discrete sections formed in the inlet manifold, and wherein each section further includes an outlet port;

a plurality of conduits connecting the inlet manifold to the at least one outlet manifold, wherein each of the plurality of conduits further includes a plurality of multichannels formed therealong; and a pressure reducing means connected to or formed integrally with the at least one outlet manifold configured to regulate the flow of refrigerant fluid through the at least one outlet manifold in relation to the flow of discharge vapor through the multichannel heat exchanger.

17. The HVAC&R system of claim 16, wherein the plurality of conduits comprise a plurality of fins.

18. The HVAC&R system of claim 16, wherein the flow of vapor and the flow of refrigerant through each section are regulated independent of the other sections.

19. The HVAC&R system of claim 16, wherein the pressure reducing means further includes reducing the cross sectional area of at least one of the at least one outlet manifolds relative to the cross section area of the inlet manifold.

20. The HVAC&R system of claim 16, wherein the pressure reducing means further includes providing an orifice formed in the at least one outlet manifold.

21. The HVAC&R system of claim 16, wherein the pressure reducing means further includes a tube having a smaller cross section area than the at least one outlet manifold connected to the at least one outlet of the at least one outlet manifold.

22. The HVAC&R system of claim 16, wherein the pressure reducing means further includes a second manifold connected to at least one outlet of the at least one outlet manifold by separate lengths of tubing, wherein at least one of the lengths of tubing connecting the at least one outlet manifold and the second manifold has a different length compared to the other lengths of tubing.

23. A heat exchanger comprising:

an inlet manifold configured to receive vapor refrigerant from a compressor, the inlet manifold being divided into a plurality of discrete input sections and each input section of the plurality of input sections having an inlet port;

an outlet manifold configured to discharge refrigerant fluid from the heat exchanger, the outlet manifold being divided into a plurality of discrete output sections, each output section of the plurality of output sections corresponding to an input section of the plurality of input sections and having an outlet port;

a plurality of circuits connecting the inlet manifold to the outlet manifold, each circuit of the plurality of circuits connecting an input section of the plurality of input sections to an output section of the plurality of output sections, each circuit of the plurality of circuits comprises a plurality of multichannel tubes; and a device connected to or formed integrally with an output section of the plurality of output sections, the device being operable to regulate the flow of refrigerant fluid through the corresponding circuit of the plurality of circuits to obtain a differential pressure drop in the corresponding circuit relative to the other circuits of the plurality of circuits, the differential pressure drop corresponding to a difference in velocity of airflow through the corresponding circuit relative to the velocity of airflow through the other circuits of the plurality of circuits.

24. The heat exchanger of claim 23, wherein the device comprises an outlet connected to the output section of the plurality of output sections, the outlet having a reduced cross sectional area relative to an inlet of the corresponding input section.

25. The heat exchanger of claim 23, wherein the device comprises an orifice formed in the output section of the plurality of output sections.

26. The heat exchanger of claim 23, wherein each output section of the plurality of output sections comprises a tube to discharge refrigerant fluid from the output section and the device comprises a tube having a smaller cross section area than the other tubes connected to the other output sections of the plurality of output sections.

27. The heat exchanger of claim 23, wherein each output section of the plurality of output sections comprises a tube to discharge refrigerant fluid from the output section and the device comprises a tube having a longer length than the other tubes connected to the other output sections of the plurality of output sections.

* * * * *